US006146161A

United States Patent [19]

Osawa

[11] Patent Number: 6,146,161

[45] Date of Patent: Nov. 14, 2000

[54] LEVER TYPE CONNECTOR

[75] Inventor: Hiroki Osawa, Yokkaichi, Japan

[73] Assignee: Sumitomo Wiring Systems, Ltd., Japan

[21] Appl. No.: 09/115,665

[22] Filed: Jul. 14, 1998

[30] Foreign Application Priority Data

Jul. 30, 1997 [JP] Japan ..... 9-204896

[51] Int. Cl.[7] ..... H01R 13/44

[52] U.S. Cl. ..... 439/140; 439/157

[58] Field of Search ..... 439/140, 141, 439/157

[56] References Cited

U.S. PATENT DOCUMENTS 5,269,696 12/1993 Okada et al. ..... 439/140

FOREIGN PATENT DOCUMENTS 0 532 366 3/1993 European Pat. Off. .
5-74517 3/1993 Japan .

*Primary Examiner*—Khiem Nguyen
*Assistant Examiner*—Son V. Nguyen
*Attorney, Agent, or Firm*—Banner & Witcoff, Ltd.

[57] ABSTRACT

A miniaturized lever is provided for an electrical lever type connector having a moving plate to support protruding terminals. Recesses are provided on cam pins of a moving plate and these fit together with cam pins of a female connector housing. As a result, the cam pins of the moving plate and female connector housing are unified, and in this unified state are then fitted in a cam groove of a lever. Consequently only a single cam groove is required, compared to the prior art where two cam grooves corresponding to the two cam pins are necessary.

11 Claims, 6 Drawing Sheets

LEVER TYPE CONNECTOR

FIELD OF THE INVENTION

The present invention relates to a lever-type electrical connector.

BACKGROUND TO THE INVENTION

In order to carry out smooth coupling of electrical connectors, which may have a high fitting resistance due to the large number of terminals, multiple-terminal connectors utilise a cam operation driven by movement of a lever. In order to support the tabs of male terminal fittings and to temporarily fix their position, a moving plate has been provided on a male connector housing, which plate moves from an advance to a retracted position with the tabs passing through it. This type of connector is described in the Laid-Open Japanese patent publication 5-74517.

An example of this type of connector is shown in FIGS. 7 to 9 of this specification. A connector is provided with a cam pin 2 on the female connector housing 1, a cam pin 4 also being provided on a moving plate 3. These cam pins 2 and 4 fit with cam grooves 6 and 7 of a lever 5. When the lever 5 is rotated, the cam pins 2 and 4 are respectively engaged with the cam grooves 6 and 7 and the female connector housing 1 is drawn towards the male connector housing 8 with the moving plate 3. Thus the projecting tabs are supported whilst they are exposed.

However, in the conventional connector described above, since the cam pins 2 and 4 of the female connector housing 1 and the moving plate 3 engage separate cam grooves 6 and 7, and because the cam grooves 6 and 7 are provided on the lever 5, this lever 5 is rather wide.

The present invention has been developed after taking the above problem into consideration, and aims to present a miniaturised lever which moves the moving plate and the female connector housing in accompaniment with the cam operation thereof.

SUMMARY OF THE INVENTION

According to the invention there is provided a lever type electrical connector comprising a first housing having a plurality of electrical terminals protruding therefrom, a plate having a plurality of apertures through which individual terminals pass, said plate being movable from an advanced position adjacent the ends of said terminals to a retracted position closer to the root of said terminals, and a lever pivotable about an axis of said first housing and defining a cam surface, said connector further comprising a second housing having a plurality of electrical terminals engageable with the terminals of said first connector, wherein said plate and second housing have followers engageable by said cam surface such that pivoting of said lever draws said plate and second housing closer to said axis thereby drawing said housings together, and moving said plate from the advanced to the retracted position, characterised in that said followers are engageable by a common cam surface.

Such a construction avoids the need for separate cam tracks for the followers of the plate and mating connector. Accordingly the lever can be miniaturised, thus giving a saving of material, the possibility of a more rigid lever, an assurance that both followers are engaged by the cam track, and an assurance that the spatial relationship between the followers is maintained.

Preferably the followers abut one another, and may rest within one another or interlock. In a preferred embodiment one of the followers is concave and the other follower fits within the concavity to define a substantially solid unitary follower. This unitary follower preferably has an arcuate surface, thus facilitating smooth engagement with the cam surface.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
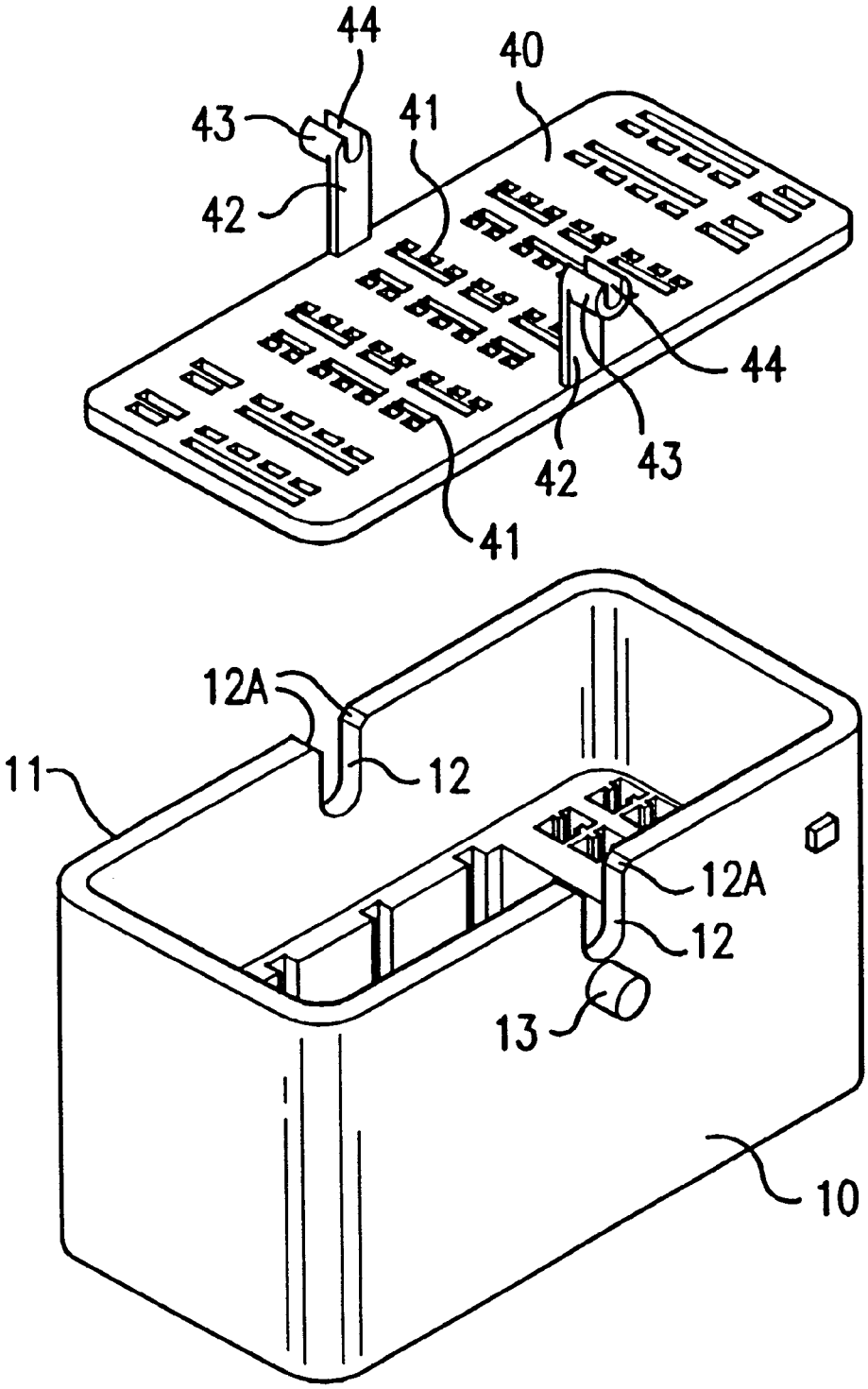
FIG. 1 is a diagonal view of a male connector housing and a moving plate of a first embodiment of the invention.

An embodiment of the present invention is explained below, with the help of FIGS. 1 to 6.

A lever-type connector according to the present invention is provided with a male connector housing 10, a female connector housing 20, a lever 30, and a moving plate 40. The male connector housing 10 has a hood 11 (on the upper face of the male connector housing 10 in the figures), a plurality of tabs of male terminal fittings (not shown) protruding upwards into the interior of the hood 11. The interior of this hood 11 fits with the female connector housing 20.

The interior of the hood 11 has the moving plate 40 provided therein so that it can move between an upper, tab supporting position and a lower, inactive position. The moving plate 40 has a plurality of position determining holes 41. When the connector housings 10 and 20 are not yet in a fitted state, the moving plate 40 is temporarily stopped in the tab supporting position by a stopping means (not shown) and the position determining holes 41 engage with the anterior ends of the tabs. This prevents the bending, change of shape, etc. of the tabs. Further, as will be explained below, during the fitting operation of the connector housings 10 and 20 the moving plate 40 moves in a downwards direction to the inner end of the hood 11), and when the connector housings 10 and 20 have been fitted together, the moving plate 40 reaches the inactive position.

On the central part of both long edges of the moving plate 40 there are upstanding protruding members 42. Round cam pins 43 extend outwards from the upper edge of each of these protruding members 42. Recesses 44 are located in the upper end of these cam pins 43 and are open at the upper side and at the interior and exterior ends. Cam pins 21 (to be explained later) of the female connector housing 20 fit with these recesses 44. The cam pins 43 can be moved along guiding grooves 12 provided on the hood 11, protruding ends of the cam pins 43 (the exterior edge) extending to the exterior. When the moving plate 40 is in the tab supporting position, the cam pins 43 are positioned in the upper part of the guide grooves 12, and when the moving plate 40 is in the inactive position, the cam pins 43 are positioned in the inner part of the guide grooves 12. Tapered faces 12A are provided on the open edges of the guide grooves 12 to facilitate the insertion therein of the cam pins 43 when the moving plate 40 is attached to the hood 11.

Supporting axles 13 are located on the exterior face of the hood 11 slightly below the lower edge of the guide grooves 12, axles 13 supporting the lever 30. A pair of arm members 32 protrude from the ends of operating members 31 of the lever 30. Located in the width-wise direction of the anterior ends of the arm members 32 are axle receiving holes 33 which fit with the axles 13, and spiral shaped cam grooves 34 which have the axle receiving holes 33 as their centre. These hole 33 and cam grooves 34 pass through the arm members 32 from their interior to their exterior faces. One end of each cam groove 34 is located at a distance father from the hole 33 and opens out to the peripheral edge of the arm member 32 to form a mouth 34A. The mouths 34A are provided with linking members 34B, which are thinner than the arm member 32, and serve to add strength. The other end of each cam groove 34 is closer to the hole 33.

Figure 3:
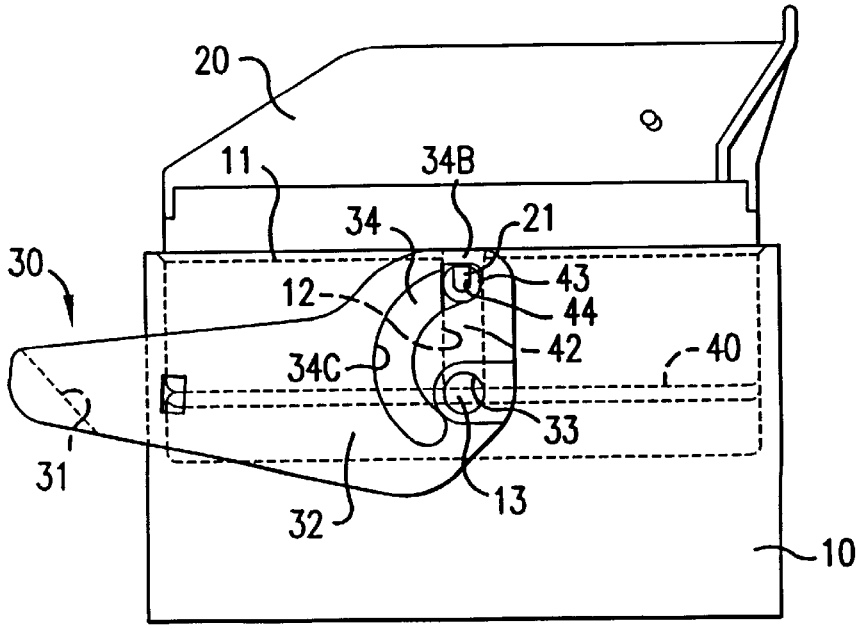
FIG. 3 is a side view of the male and female connector housings during the fitting operation.
Figure 4:
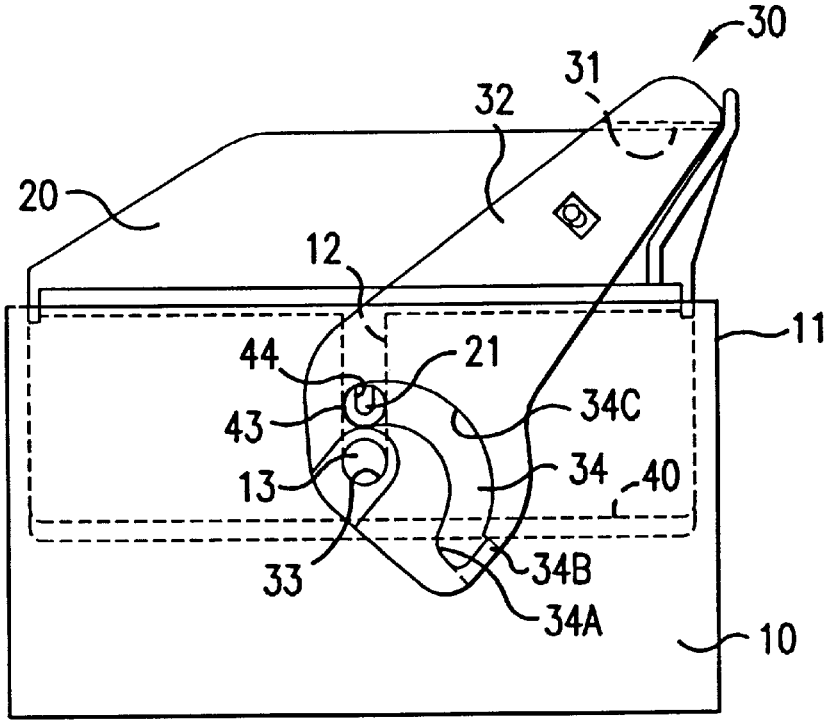
FIG. 4 is a side view of the male and female connector housing after the fitting operation has been completed.

The lever 30 can be rotated about the axle receiving hole 33 between a commencing fitting position (see FIGS. 2 and 3), and a completed fitting position (see FIG. 4). In the commencing position, the mouth 34A of the cam groove 34 coincides with the upper edge of the guide groove 12. In the completed position, the opposing, inner edge of the cam groove 34 coincides with the lower edge of the guide groove 12.

Figure 5:
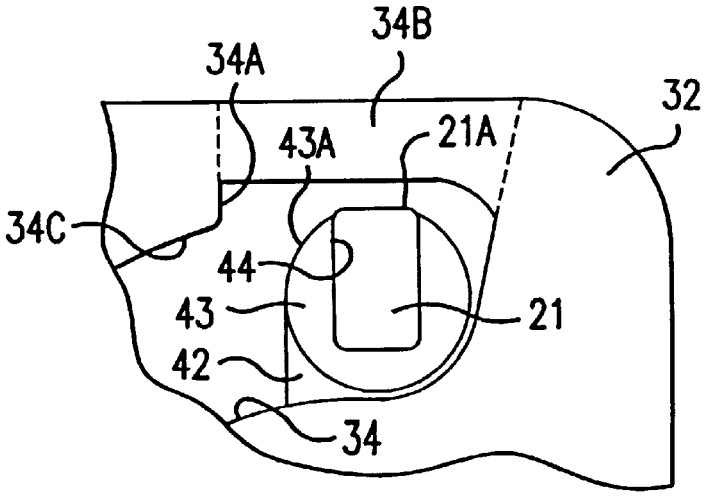
FIG. 5 is a partially enlarged side view of cam pins in a unified state.

The female connector housing 20 has a plurality of female terminal fittings (not shown) which fit together with the tabs of the male terminal fittings, and the lower edge of the female connector housing 20 fits together with the hood 11 of the male connector housing 10. On both side faces of the female connector housing 20 there are cam pins 21 which fit tightly into the respective recesses 44. Whereas the cam pins 43 of the moving plate 40 are approximately cylindrical, the cam pins 21 of the female connector housing 20 are of an approximately square section. The outer peripheral faces 21A on the upper edges of the cam pins 21 are arc-shaped which are concentric with and have the same radius as the cam pins 43 of the moving plate 40. As a result, when the cam pins 21 and 43 are in a fitted state, the outer peripheral faces 21A and 43A form a smooth arc (FIG. 5).

Next, the operation of the present embodiment is explained. When the moving plate 40 and the lever 30 are to be attached to the male housing 10, first the lever 30 is attached and brought down to the commencing fitting position and, from this state, the moving plate 40 within the hood 11 is attached. At this point, the cam pins 43 are fitted together with the upper edge of the guide grooves 12, and the tabs are made to fit with the position determining holes 41, the moving plate 40 being temporarily retained in the tab supporting position (see FIG. 2). In this state, the cam pins 43 fit together with the respective mouths 34A of the cam grooves 34. When the female connector housing is fitted from this state, the lower edge of the female connector housing 20 fits together with the interior of the hood 11 and the cam pins 21 of the female connector housing 20 enter into and fit with the recesses, and thereafter move as a unified member.

Figure 2:
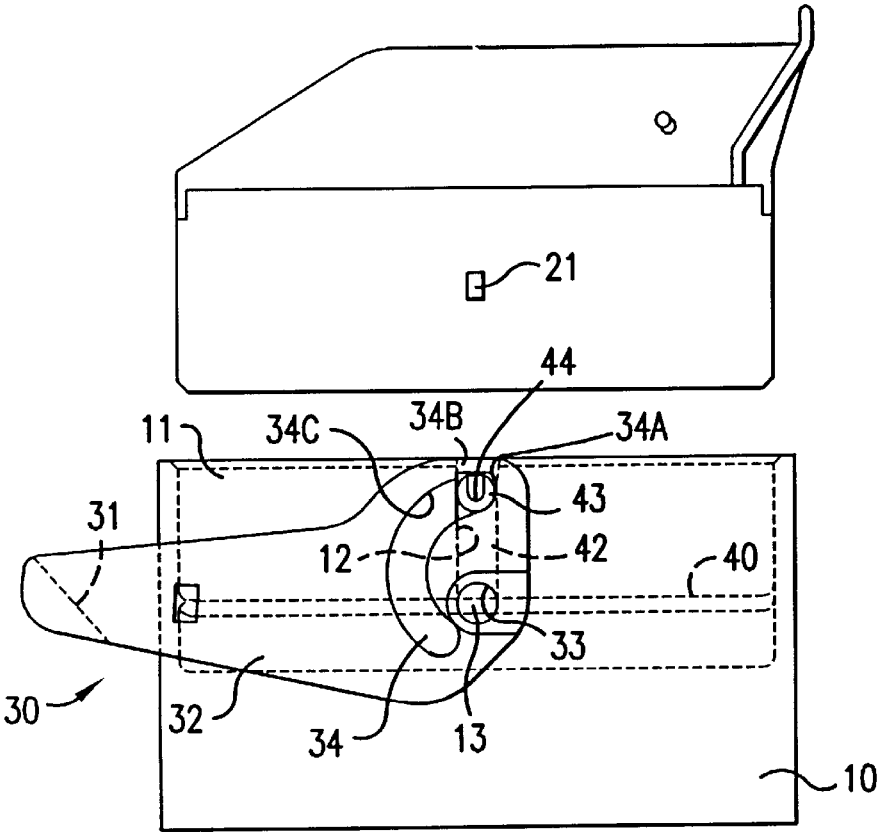
FIG. 2 is a diagonal view of a male connector housing and a female connector housing prior to being fitted together.

After the cam pins 21 and 43 have been fitted, the lever 30 is rotated in a clockwise direction, as shown in FIGS. 2 to 4. The cam pins 21 and 43, fitting together as a unified member, fit with the cam groove 34, the cam operation commences and the rotative force of the lever 30 exerts a force on the cam pins 21 and 43 and pulls them downwards. As a consequence, the moving plate 40 and the female connector housing 20 are drawn as a single body into the interior of the hood 11. When the lever 30 reaches the completed fitting position, the connector housings 10 and 20 have reached a fitted state and the moving plate 40 is in the inactive position.

While the cam pins 21 and 43 are being fitted into the cam groove 34, and the lever 30 has just begun to be rotated, a cam face 34C of the cam groove 34 makes contact from a position close to the top thereof and, as a result, the pushing force of the lever 30 is exerted primarily on the outer peripheral faces 21A of the cam pin 21 of the female connector housing 20. As the lever 30 continues to be rotated, the cam face 34C which faces the cam pins 21 and 43 gradually moves diagonally in a corresponding direction and the cam face 34C makes contact with the outer peripheral faces 21A and 43A of the cam pin 21 and of the cam pin 43. In the completed fitting (completed rotation) state, the cam face 43C makes contact with only the outer peripheral face 43A.

In this manner the contact portion of the cam face 43C and the cam pins 21 and 43 changes position through the operation of the cam and, as the outer peripheral faces 21A and 43A join to form a smooth arc, the operation of the cam can be carried out smoothly.

Further, although the point of contact and the direction of pushing of the cam pins 21 and 43 changes, the cam pins 21 and 43 are reliably fitted together by means of the recesses 44. Accordingly, the operation of the cam is carried out in a stable manner, and the female connector housing 20 and the moving plate 40 move as a single body.

Moreover, while the lever 30 is being rotated, the cam pins 21 and 43 fit with the guide groove 12 and therefore, even though the direction of pushing from the cam face 34C is diagonal relative to the direction of movement of the cam pins 21 and 43, the cam pins 21 and 43 do not move laterally and further stabilisation of the operation of the cam is achieved.

Figure 6:
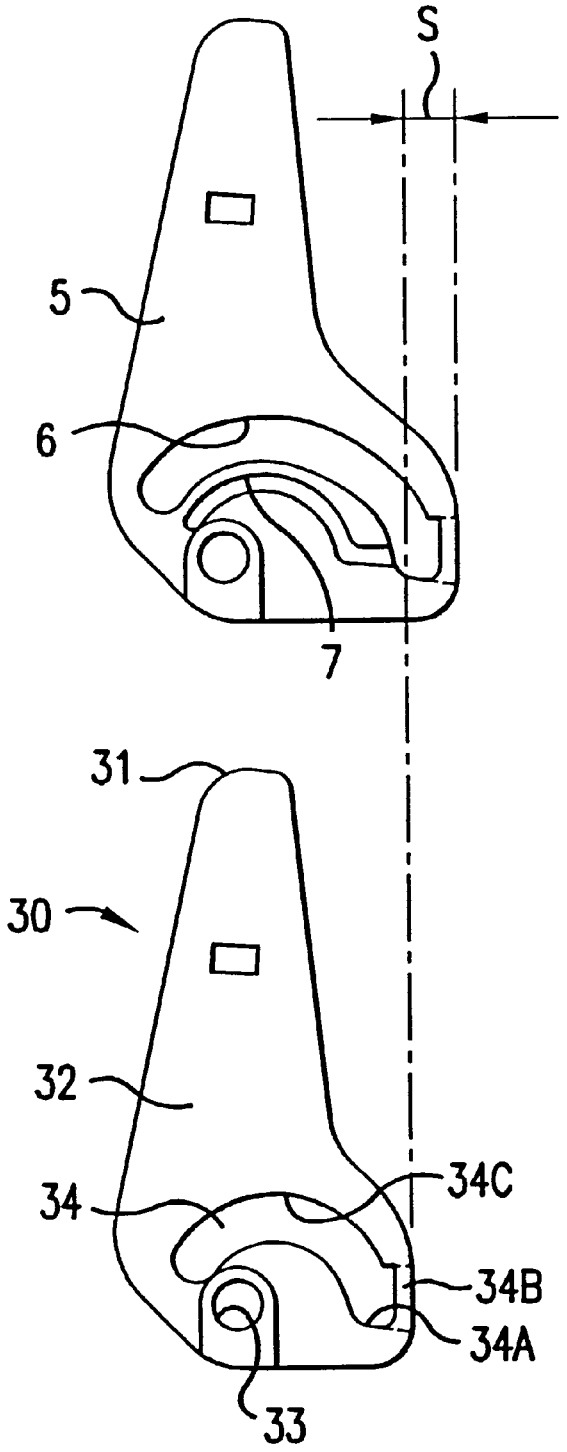
FIG.6 PRIOR ART
FIG. 6 is a side view comparing the size of a lever of the embodiment with the lever of a prior art connector.
Figure 7:
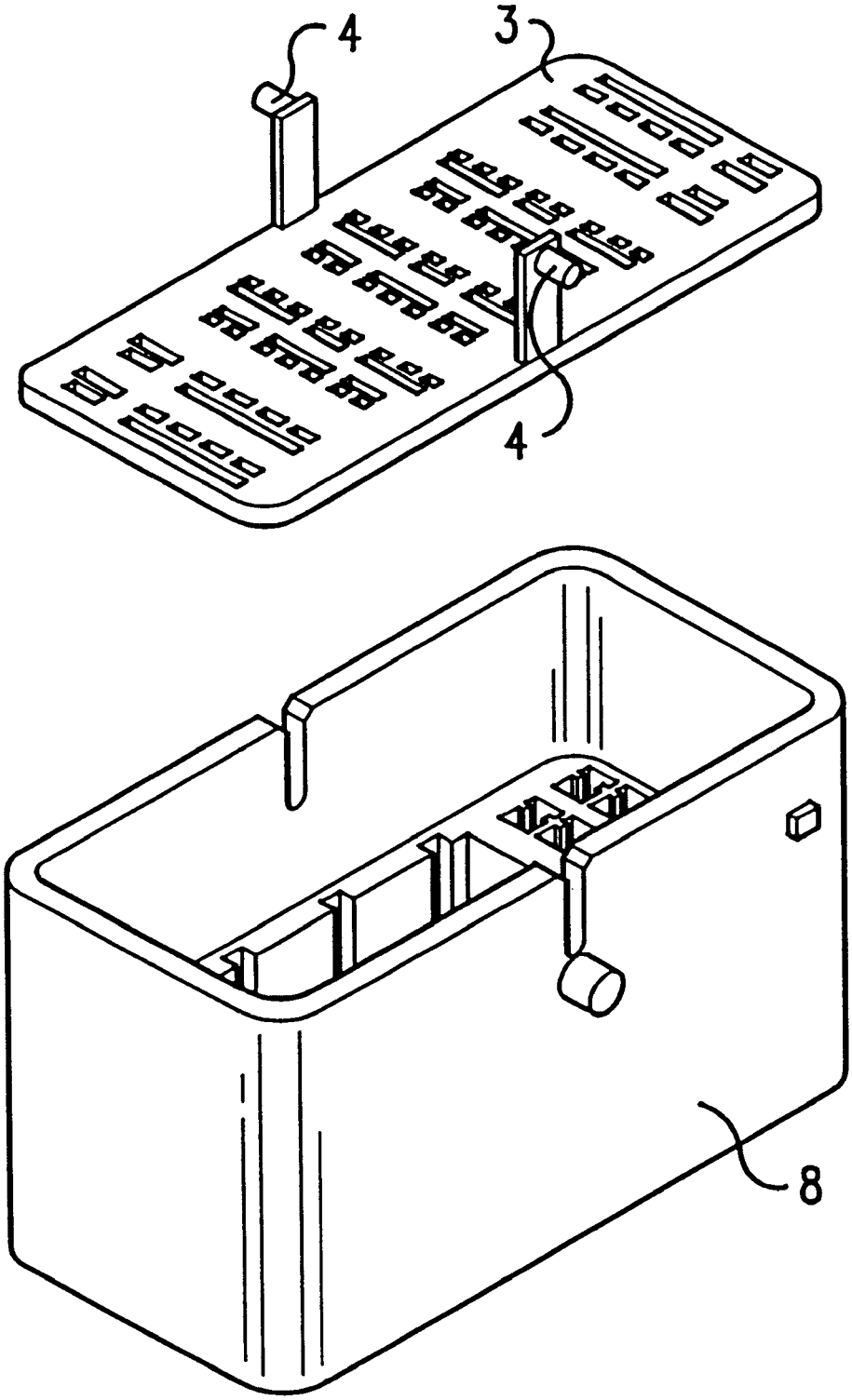
FIG.7 PRIOR ART
FIG. 7 is a diagonal view of a male connector housing and a moving plate of a prior art connector.
Figure 8:
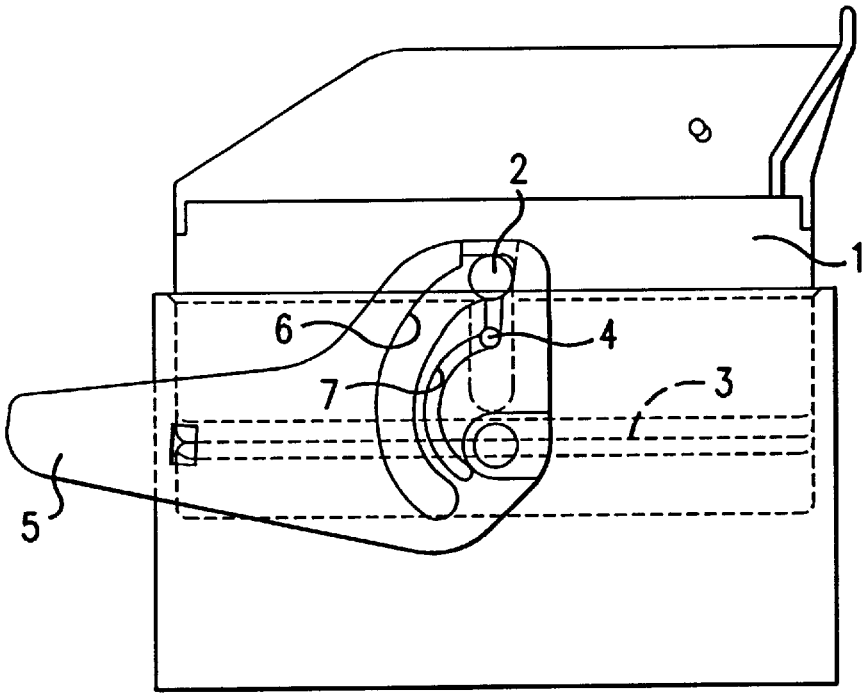
FIG.8 PRIOR ART
FIG. 8 is a side view showing the male and female connector housings of the prior art connector during the fitting operation.
Figure 9:
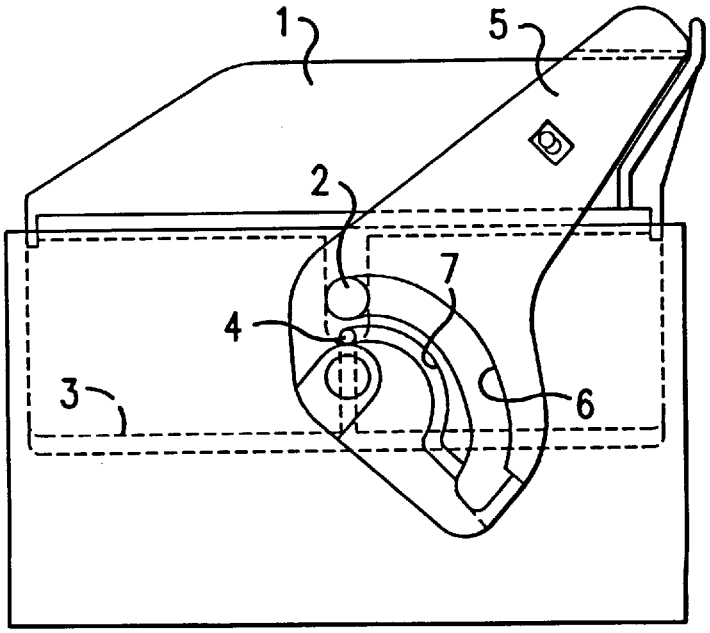
FIG. 9 is a side view showing the male and female connector housings of the prior art connector.

As described above, in the present embodiment the cam pins 21 and 43 of the female connector housing 20 and the moving plate 40 are fitted together to form a unified body and then fitted with the cam groove 34. As a result, as can be seen in FIG. 6, compared to a lever 5 of the conventional example in which two cam grooves 6 and 7 correspond respectively to cam pins 2 and 4 (see FIGS. 7 and 8), the dimension S of the lever 30 is smaller.

Further, since the cam pins 21 of the female connector housing 20 enters into and fit with the recesses 44, and the cam pins 21 and 43 are fitted together, compared to the case where two flat faces are merely fitted together, the fitted state of the cam pins 21 and 43 can be maintained more reliably.

Moreover, as the outer peripheral face 43A of the cam pin 43 and the outer peripheral face 21A of the cam pin 21 join to form a smooth arc, the cam operation can be carried out smoothly.

The present invention is not limited to the embodiments described above with the aid of figures. For example, the possibilities described below also lie within the technical range of the present invention. In addition, the present invention may be embodied in various other ways without deviating from the scope of the claims thereof.

(1) In the above embodiment the cam pins 43 of the moving plate 40 have recesses 44 which are fitted together with cam pins 21 of the female connector housing 20. However, it is equally possible that the cam pins of the female connector housing be provided with recesses and that cam pins of the moving plate fit with these.

(2) In the above embodiment, recesses 44 of the cam pins 43 are made to fit with corresponding cam pins 21, and both cam pins are unified. However, according to the present invention, the cam pins need not be unified by means of recesses. They may equally be unified by means of two flat faces which simply meet, or by means of two stepped members, etc.

(3) In the above embodiment, the outer peripheral faces 43A and 21A of the cam pins 43 and 21 of the moving plate 40 and the female connector housing join to form a smooth arc. However, according to the present invention, they may equally well join to form an oval shape or other curved shape other than a true circle.

What is claimed is:

1. A lever type electrical connector comprising a first housing having a plurality of electrical terminals protruding therefrom, each electrical terminal having a free end and a root, a plate having a plurality of apertures through which individual terminals pass, said plate being movable from an advanced position adjacent the free ends of said terminals to a retracted position closer to the root of said terminals, and a lever attached to said first housing for pivotal movement about an axis, said lever including a cam surface, said connector further comprising a second housing having a plurality of electrical terminals engageable with the terminals of said first housing, wherein said plate and second housing each have cam pins which are received and directed by the same said cam surface such that pivoting of said lever draws said first and second housings together, and moves said plate from the advanced to the retracted position.

2. A connector according to claim 1 wherein said cam pins abut one another in use.

3. A connector according to claim 2 wherein said cam pins are adapted to nest within one another.

4. A connector according to claim 3 wherein one of said cam pins is generally concave, and the other of said cam pins fits closely within said one cam pin to define a unitary member having a substantially solid cross section.

5. A connector according to claim 4 wherein said unitary member has an arcuate outer surface for engagement by said cam surface.

6. A connector according to claim 3 wherein said cam pins have a form locking profile.

7. A connector according to claim 1 wherein said cam pins comprise pin-like projections.

8. A connector according to claim 1 wherein said cam surface comprises an arcuate track.

9. A connector according to claim 7, wherein said cam surface comprises a slot.

10. A connector according to claim 1 wherein said first housing defines a channel in a wall thereof, the cam pins of said plate comprising a protrusion adapted to be guided in said channel and projecting to the exterior thereof for engagement by said cam surface.

11. A connector according to claim 1 wherein said lever comprises two arms pivotable about a common axis, the free ends of said arms being connected by a bridge member, each of said arms defining a cam surface, and respective cam pins being provided on either side of said plate and second housing.

* * * * *